US012426677B2

(12) United States Patent
Durflinger et al.

(10) Patent No.: US 12,426,677 B2
(45) **Date of Patent: *Sep. 30, 2025**

(54) SOLE STRUCTURE FOR ARTICLE OF FOOTWEAR

(71) Applicant: NIKE, Inc., Beaverton, OR (US)

(72) Inventors: Nate Durflinger, Beaverton, OR (US); Christopher J. Lyke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 10 days.

This patent is subject to a terminal disclaimer.

(21) Appl. No.: 18/408,398

(22) Filed: Jan. 9, 2024

(65) Prior Publication Data

US 2024/0148106 A1 May 9, 2024

Related U.S. Application Data

(63) Continuation of application No. 17/393,271, filed on Aug. 3, 2021, now Pat. No. 11,896,080.

(60) Provisional application No. 63/064,534, filed on Aug. 12, 2020.

(51) Int. Cl.

| | |
|---|---|
| ***A43B 13/18*** | (2006.01) |
| ***A43B 13/14*** | (2006.01) |
| ***A43B 13/20*** | (2006.01) |

(52) U.S. Cl.

CPC ..... *A43B 13/186* (2013.01); *A43B 13/14* (2013.01); *A43B 13/185* (2013.01); *A43B 13/20* (2013.01)

(58) Field of Classification Search

CPC ... A43B 13/188; A43B 13/186; A43B 13/185; A43B 13/20; A43B 13/181; A43B 13/187; A43B 13/183; A43B 13/14; A43B 21/32

See application file for complete search history.

(56) References Cited

U.S. PATENT DOCUMENTS

| | | | | |
|---|---|---|---|---|
| 5,343,639 A * | 9/1994 | Kilgore | A43B 13/183 36/35 B |
| 5,353,523 A | 10/1994 | Kilgore et al. | |
| 5,743,028 A | 4/1998 | Lombardino | |
| 5,771,606 A * | 6/1998 | Litchfield | A43B 13/203 36/71 |
| 6,041,521 A | 3/2000 | Wong | |

(Continued)

OTHER PUBLICATIONS

European Patent Office International Search Report/Written Opinion for Application No. PCT/US2021/045177 dated Nov. 12, 2021.

(Continued)

*Primary Examiner* — Haley A Smith

(74) *Attorney, Agent, or Firm* — Honigman LLP; Matthew H. Szalach; Jonathan P. O'Brien

(57) ABSTRACT

A sole structure for an article of footwear comprises a cushioning element including a first material and a cradle including a second material. The cradle is attached to the cushioning element and includes a first plate disposed against the cushioning element and a second plate spaced apart from the cushioning element, the second plate including an aperture. The sole structure additionally includes a bladder disposed within the cradle and including a first portion contacting the first plate and a second portion extending through the aperture of the second plate.

16 Claims, 11 Drawing Sheets

(56) References Cited

U.S. PATENT DOCUMENTS

| | | | | |
|---|---|---|---|---|
| 6,354,020 | B1 * | 3/2002 | Kimball | A43B 13/203 36/35 B |
| 6,968,636 | B2 * | 11/2005 | Aveni | A43B 13/181 36/114 |
| 7,533,477 | B2 * | 5/2009 | Goodwin | A43B 3/0052 36/35 B |
| 7,694,438 | B1 | 4/2010 | Christensen et al. | |
| 10,159,307 | B2 * | 12/2018 | Case | A43B 13/12 |
| 10,321,735 | B2 * | 6/2019 | Connell | A43B 13/141 |
| 2004/0194347 | A1 * | 10/2004 | Aveni | A43B 7/1464 36/91 |
| 2005/0102857 | A1 | 5/2005 | Yen | |
| 2005/0102858 | A1 | 5/2005 | Yen | |
| 2005/0102859 | A1 | 5/2005 | Yen | |
| 2005/0268490 | A1 | 12/2005 | Foxen | |
| 2007/0084081 | A1 | 4/2007 | Fallon | |
| 2009/0100705 | A1 | 4/2009 | Cook et al. | |
| 2013/0160327 | A1 | 6/2013 | Peyton et al. | |
| 2013/0192087 | A1 * | 8/2013 | Litchfield | A43B 13/203 36/43 |
| 2017/0265566 | A1 * | 9/2017 | Case | A43B 13/186 |
| 2018/0213886 | A1 | 8/2018 | Connell et al. | |
| 2020/0022454 | A1 | 1/2020 | Eldem et al. | |
| 2021/0368918 | A1 | 12/2021 | Lyke | |

OTHER PUBLICATIONS

USPTO, Final Office Action for U.S. Appl. No. 17/393,271, mailed Jul. 19, 2023.

USPTO, Non-Final Office Action for U.S. Appl. No. 17/393,271, mailed Jan. 5, 2023.

* cited by examiner

SOLE STRUCTURE FOR ARTICLE OF FOOTWEAR

CROSS REFERENCE TO RELATED APPLICATIONS

This application is a continuation of U.S. application Ser. No. 17/393,271, filed on Aug. 3, 2021, which claims priority under 35 U.S.C. § 119(e) to U.S. Provisional Application No. 63/064,534, filed on Aug. 12, 2020. The disclosures of these prior applications are considered part of the disclosure of this application and are hereby incorporated by reference in their entirety.

FIELD

The present disclosure relates generally to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
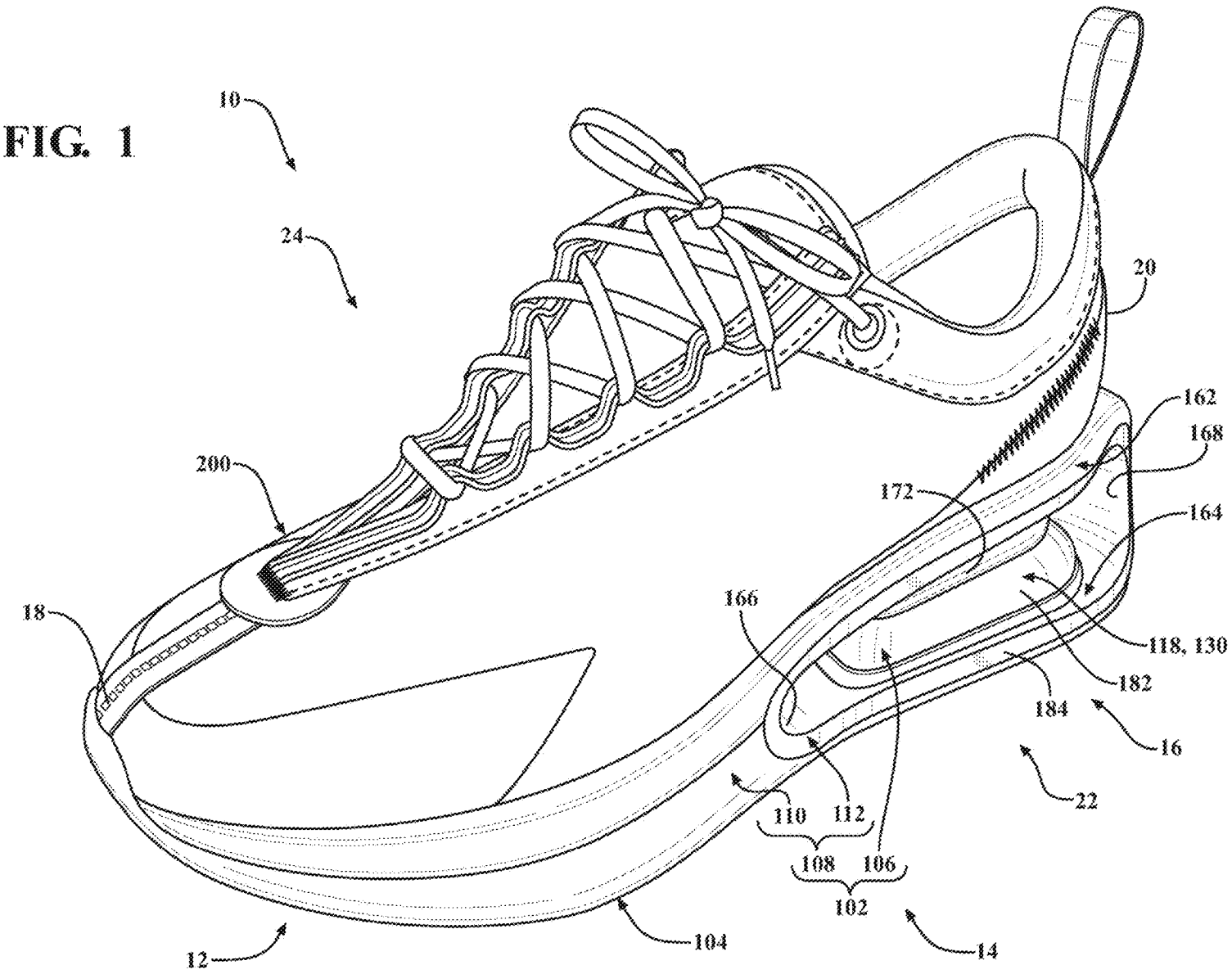
FIG. 1 is a lateral side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear is provided and comprises a cushioning element including a first material and a cradle including a second material. The cradle is attached to the cushioning element and includes a first plate disposed against the cushioning element and a second plate spaced apart from the cushioning element, the second plate including an aperture. The sole structure additionally includes a bladder disposed within the cradle and including a first portion contacting the first plate and a second portion extending through the aperture of the second plate.

The sole structure may include one or more of the following optional features. For example, an outsole may be disposed adjacent to the second plate on an opposite side of the cradle from the cushioning element. In this configuration, the second portion of the bladder may contact the outsole. Additionally or alternatively, the second plate may surround the second portion of the bladder.

In one configuration, the first plate and the second plate may partially define a receptacle extending continuously through the cradle from a first side to a second side. The cradle may include an arcuate first end support connecting the first plate and the second plate at a first end of the cradle. The first end support may be spaced apart from the bladder. Additionally or alternatively, the cradle may include an arcuate second end support connecting the first plate and the second plate at a second end of the cradle. The first end support and the second end support may be spaced apart from the bladder. The first end support may be a different size than the second end support.

In another configuration, a sole structure for an article of footwear is provided and comprises a cushioning element, a cradle received by the cushioning element and defining a receptacle extending continuously through the cradle from a first side of the sole structure to a second side of the sole structure, and a bladder including a first portion disposed within the receptacle and a second portion extending through the cradle.

The sole structure may include one or more of the following optional features. In one configuration, an outsole may be disposed on an opposite side of the cradle from the cushioning element. In this configuration, the second portion of the bladder may contact the outsole through the cradle.

In one configuration, the cradle may include a first plate surrounding the second portion of the bladder. A second plate may be spaced apart from the first plate. In this configuration, the first portion of the bladder may contact the second plate.

The cradle may include an arcuate first end support connecting the first plate and the second plate at a first end of the cradle. The first end support may be spaced apart from the bladder. Additionally or alternatively, the cradle may include an arcuate second end support connecting the first plate and the second plate at a second end of the cradle. The first end support and the second end support may be spaced apart from the bladder. The first end support may be a different size than the second end support.

Figure 5:
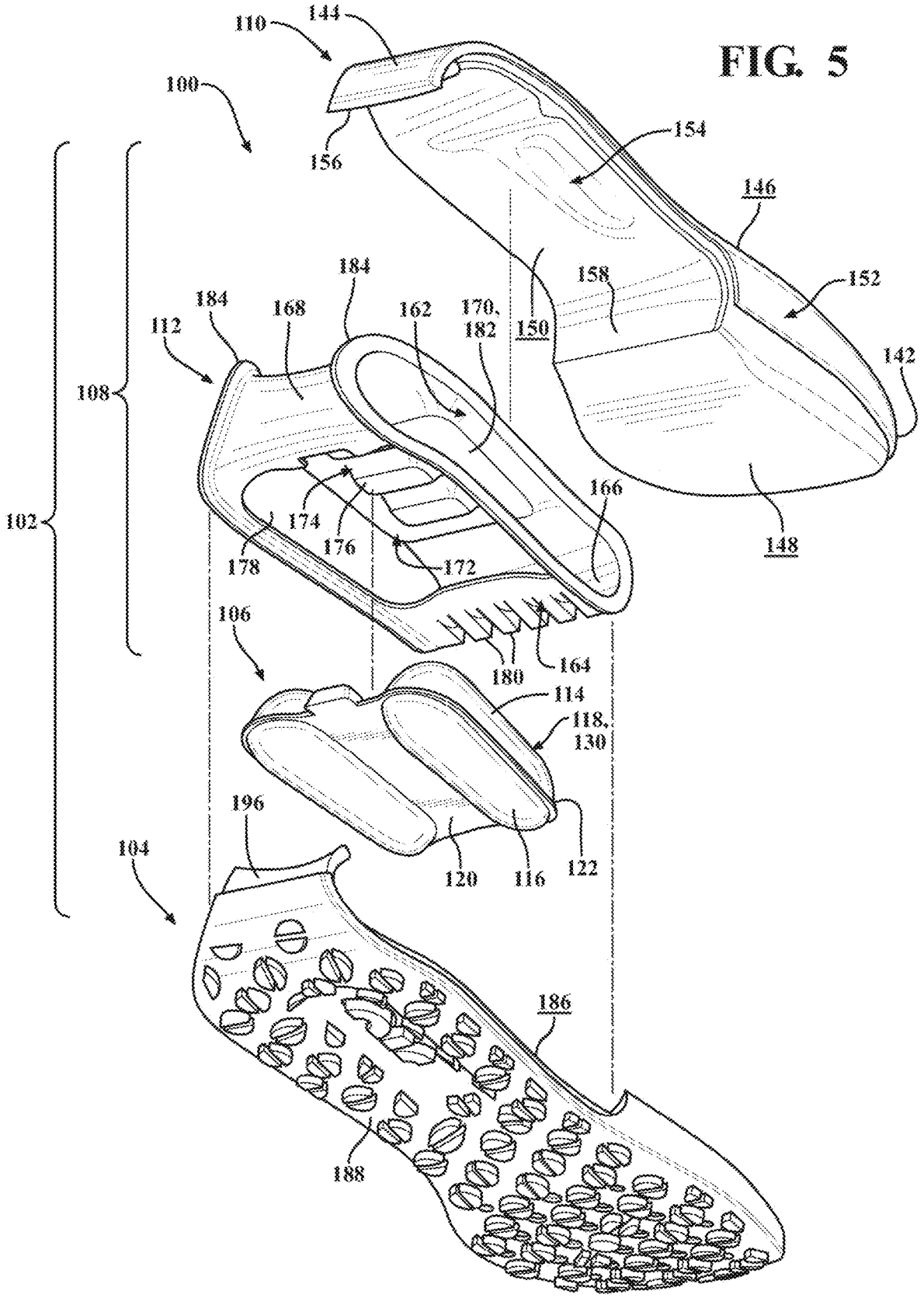
FIG. 5 is a bottom perspective exploded view of a sole structure of the article of footwear of FIG. 1.

Referring to FIGS. 1-10, an article of footwear 10 is provided, which includes a sole structure 100 and an upper 200 attached to the sole structure 100. The article of footwear 10 may be divided into one or more regions. The regions may include a forefoot region 12, a mid-foot region 14, and a heel region 16. The forefoot region 12 corresponds to the phalanges and the metatarsophalangeal joint (i.e., "the ball") of the foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a lateral side 22 and a medial side 24, as shown in FIG. 5. Accordingly, the lateral side 22 and the medial side 24 respectively correspond with opposite sides of the footwear 10 and extend through the regions 12, 14, 16.

Figure 2:
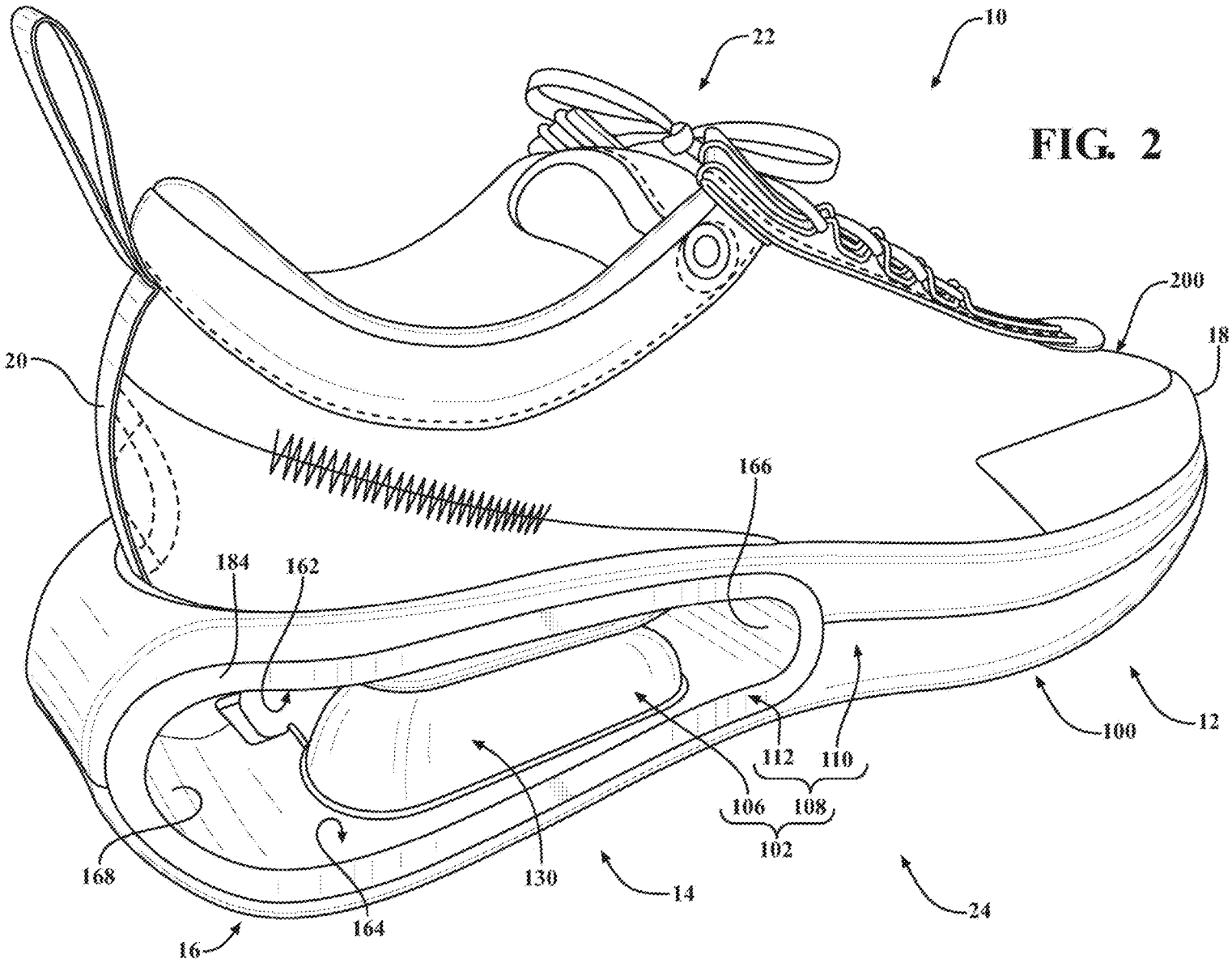
FIG. 2 is a medial side perspective view of the article of footwear of FIG. 1.
Figure 3:
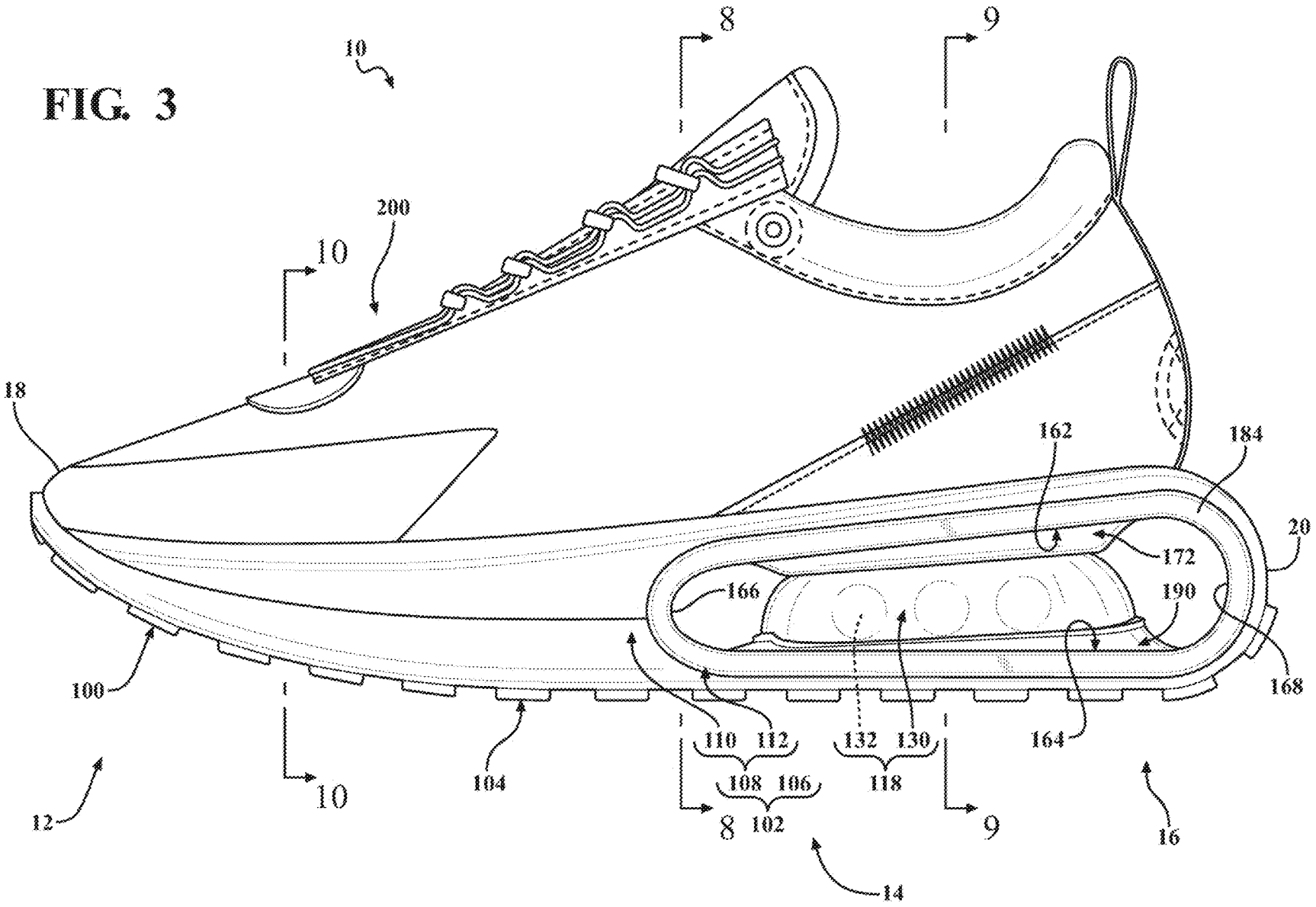
FIG. 3 is a lateral side elevation view of the article of footwear of FIG. 1.
Figure 4:
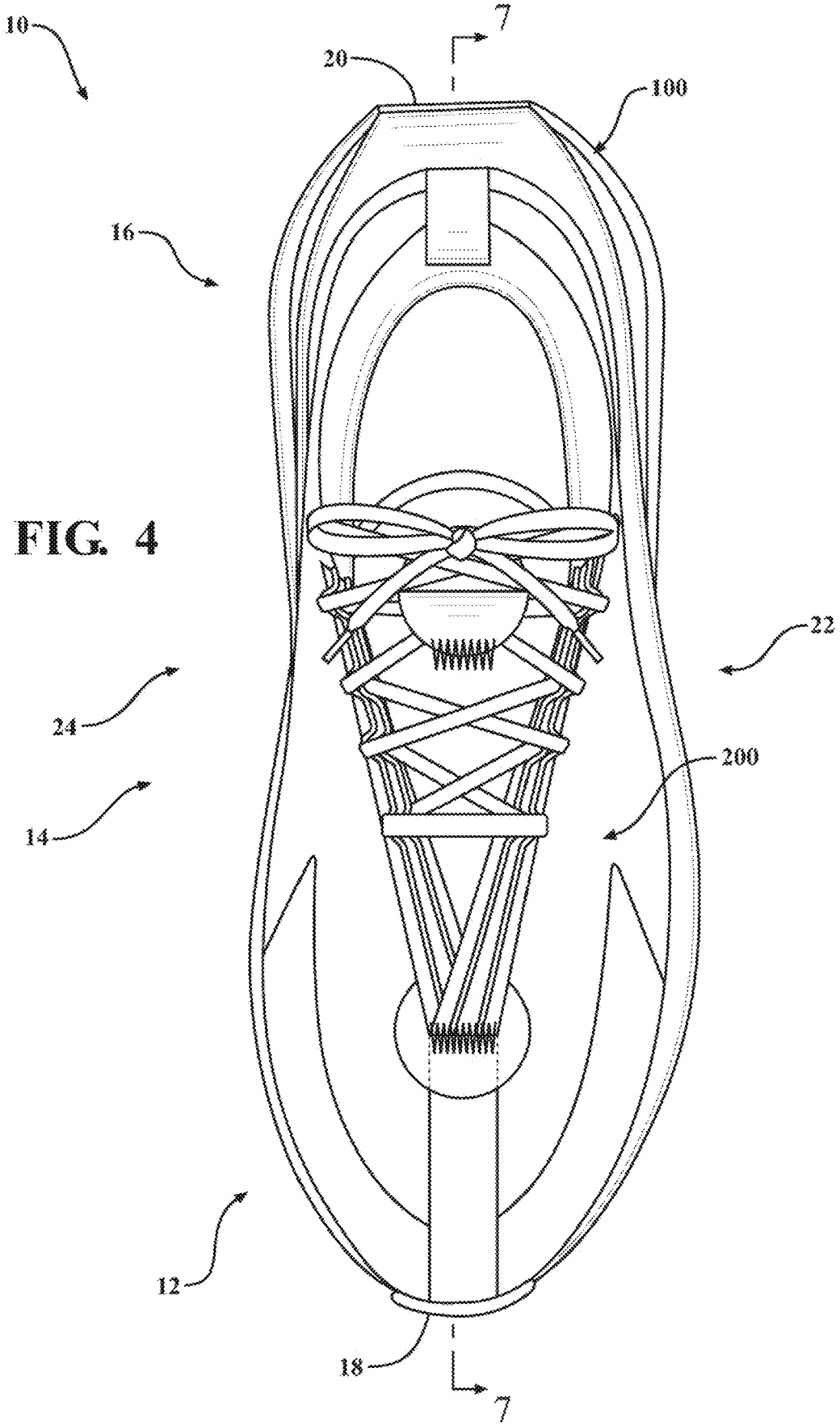
FIG. 4 is a top plan view of the article of footwear of FIG. 1.

With reference to FIGS. 1-3, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 may be described as including a bladder 106 and a chassis 108, where the chassis 108 is configured to be attached to the upper 200 and provides an interface between the upper 200, the bladder 106, and the outsole 104.

Generally, the bladder 106 of the sole structure 100 is supported within the heel region 16 of the chassis 108 and is configured to attenuate forces associated with impacts in the heel region 16. The bladder 106 of the midsole 102 includes an opposing pair of barrier layers 114, 116, which are joined to each other at discrete locations to define a chamber 118, a web area 120, and a peripheral seam 122. In the illustrated embodiment, the barrier layers 114, 116 include a first, upper barrier layer 114 and a second, lower barrier layer 116. Alternatively, the chamber 118 can be produced from any suitable combination of one or more barrier layers, as described in greater detail below.

In some implementations, the upper barrier layer 114 and the lower barrier layer 116 cooperate to define a geometry (e.g., thicknesses, width, and lengths) of the chamber 118. For example, the web area 120 and the peripheral seam 122 may cooperate to bound and extend around the chamber 118 to seal the fluid (e.g., air) within the chamber 118. Thus, the chamber 118 is associated with an area of the bladder 106 where interior surfaces of the upper and lower barrier layers 114, 116 are not joined together and, thus, are separated from one another.

Figure 7:
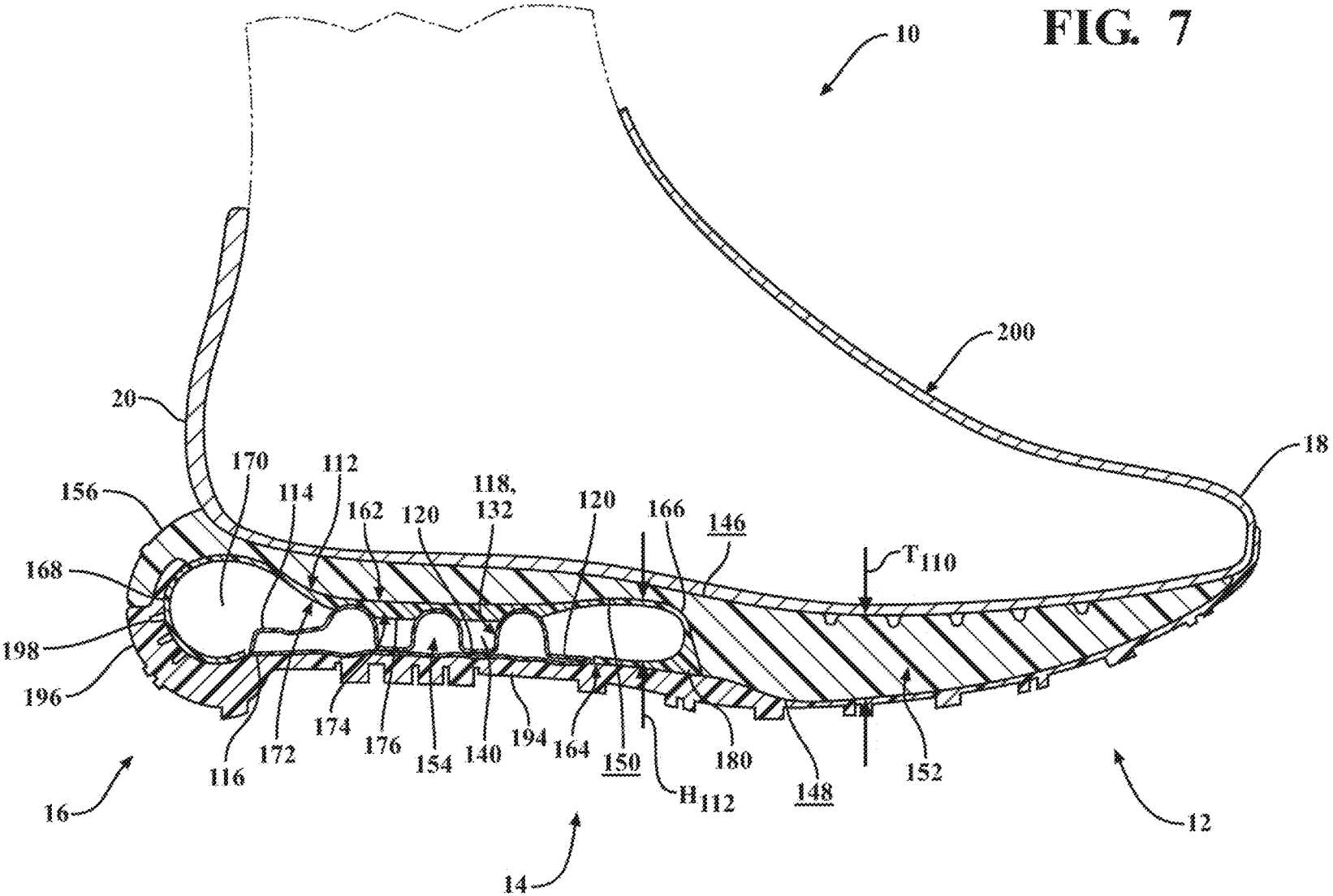
FIG. 7 is a cross-sectional view of the article of footwear of FIG. 1, taken along Line 7-7 of FIG. 4.
Figure 8:
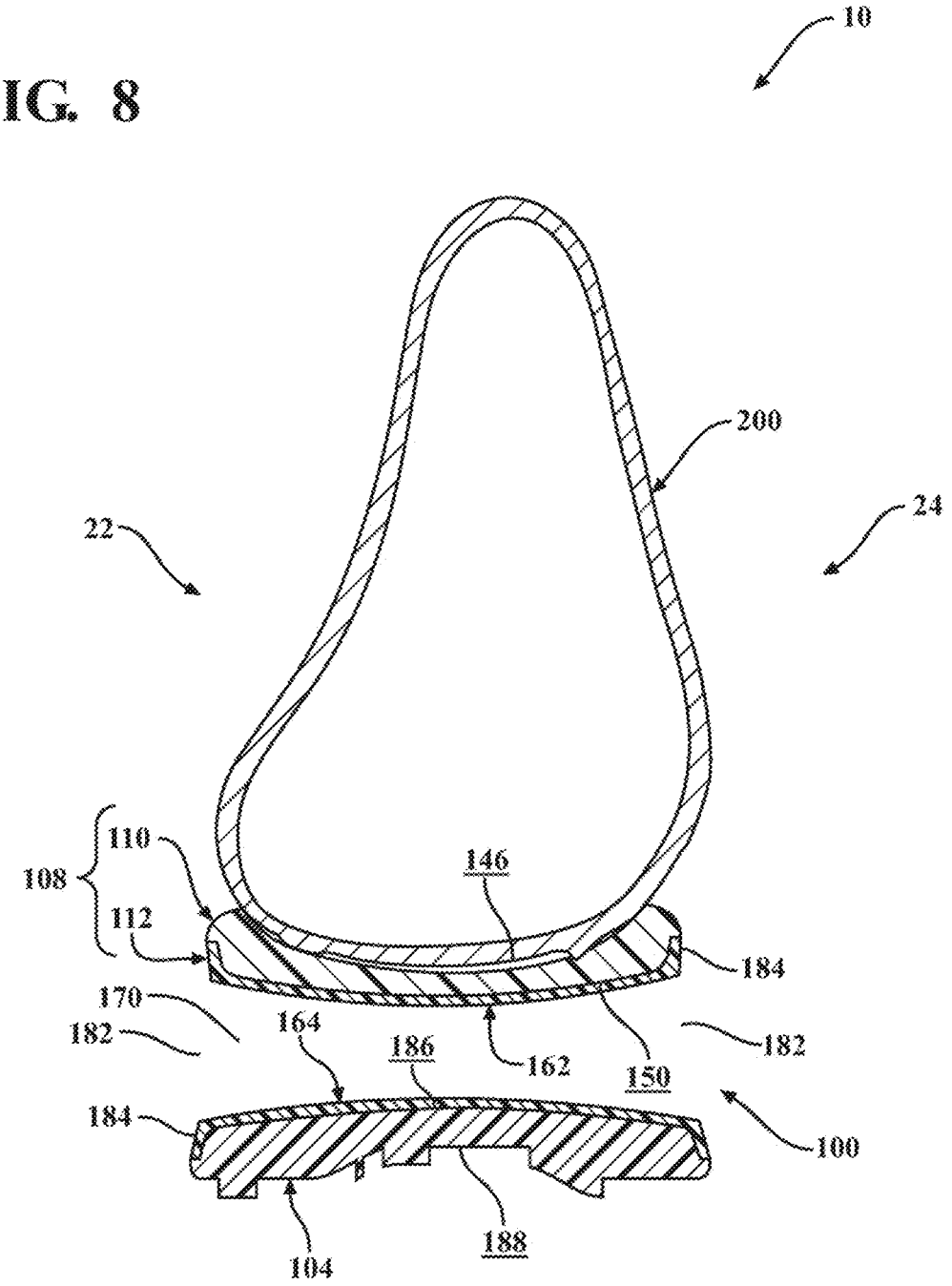
FIG. 8 is a cross-sectional view of the article of footwear of FIG. 1, taken along Line 8-8 of FIG. 3.
Figure 9:
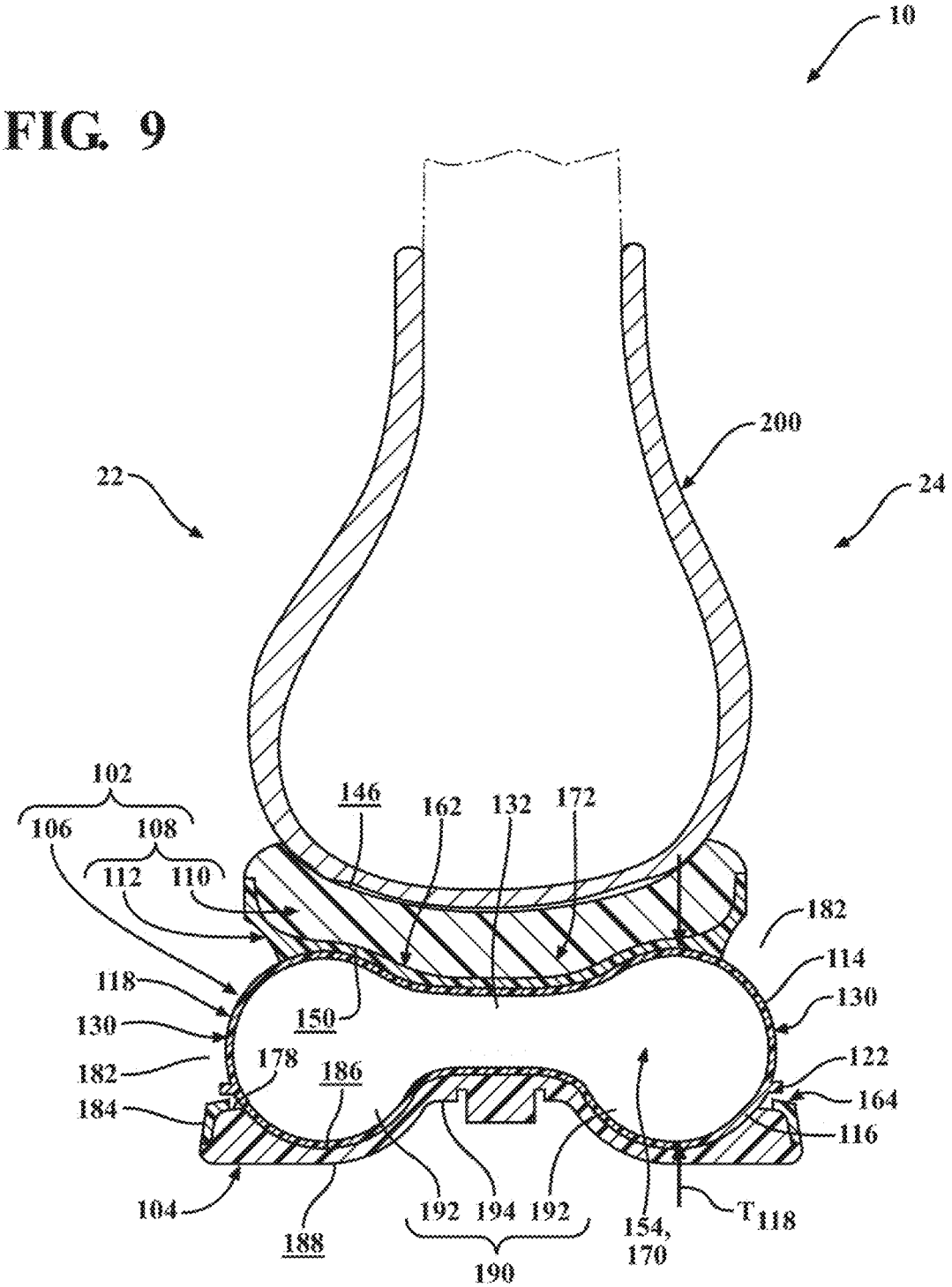
FIG. 9 is a cross-sectional view of the article of footwear of FIG. 1, taken along Line 9-9 of FIG. 3.
Figure 10:
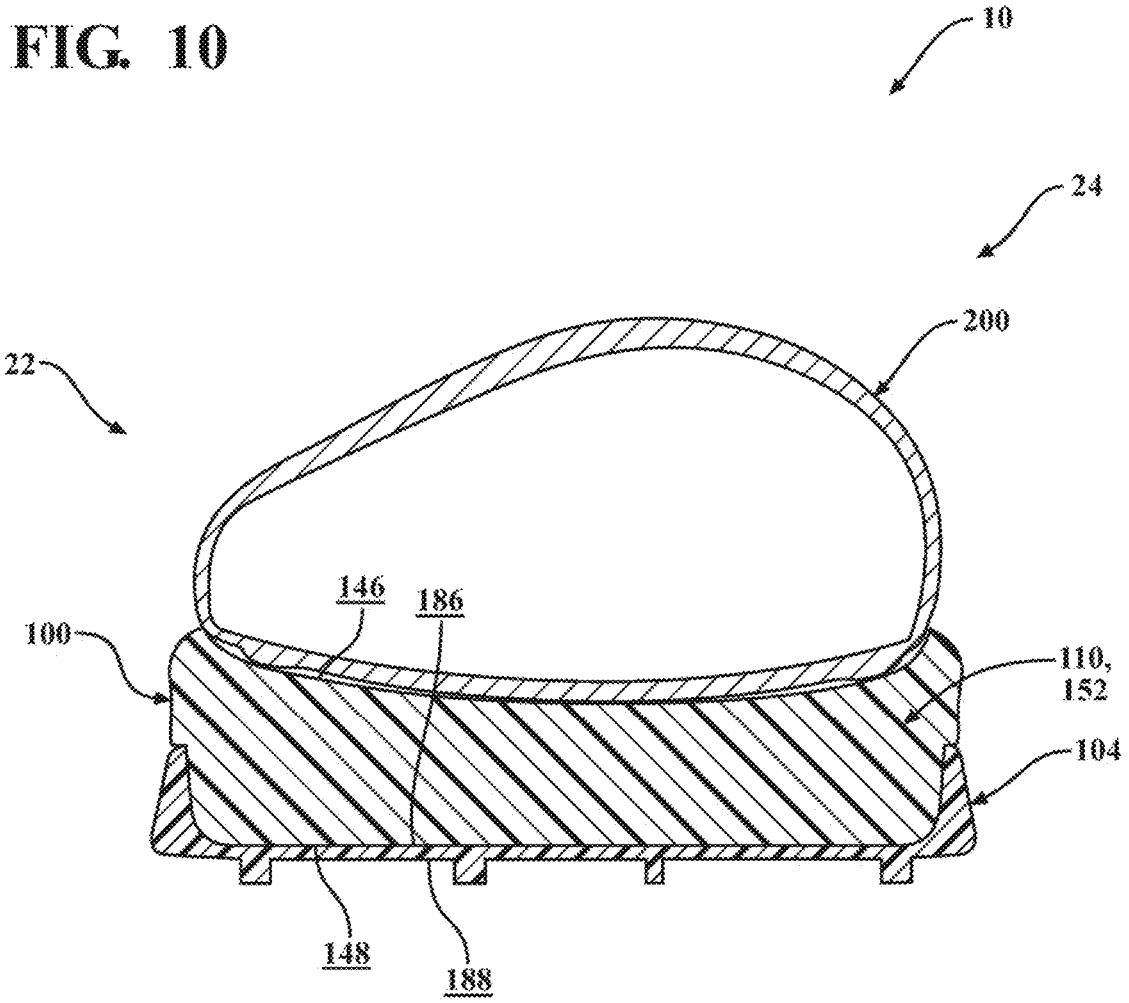
FIG. 10 is a cross-sectional view of the article of footwear of FIG. 1, taken along Line 10-10 of FIG. 3.

As shown in FIGS. 7 and 9, a space formed between opposing interior surfaces of the upper and lower barrier layers 114, 116 defines an interior void of the chamber 118. Similarly, exterior surfaces of the upper and lower barrier layers 114, 116 define an exterior profile of the chamber 118.

Thicknesses $T_{118}$ of the chamber 118 are defined by the distance between the upper and lower barrier layers 114, 116 of the bladder 106.

Figure 11:
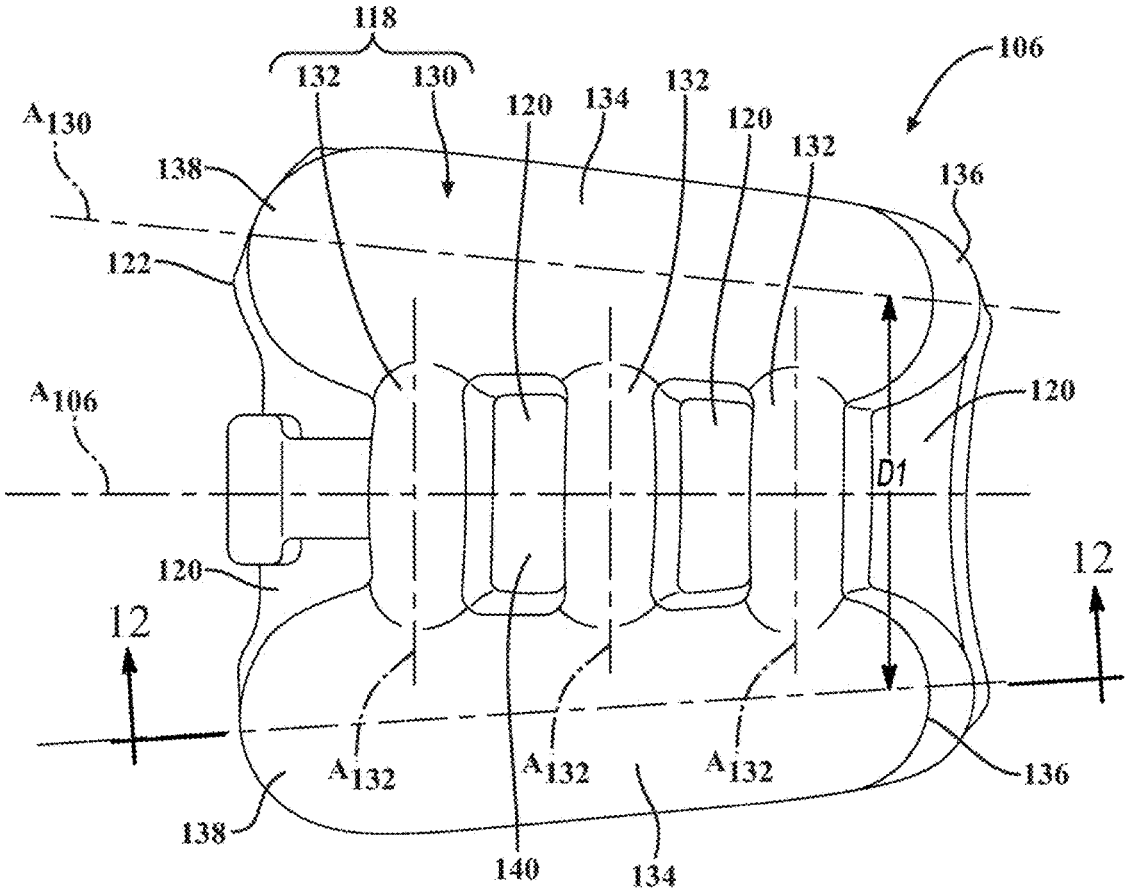
FIG. 11 is a top plan view of a bladder of a sole structure in accordance with principles of the present disclosure.

As best shown in FIG. 11, the chamber 118 includes a plurality of segments 130, 132 that cooperate to provide characteristics of responsiveness and support to the midsole 102. Particularly, the segments 130, 132 may be described as including a pair of cushions 130 on opposite sides of the bladder 106, which are connected (i.e., in fluid communication) with each other by one or more conduits 132. When assembled to in the sole structure 100, the cushions 130 of the chamber 118 are configured to be at least partially exposed along a peripheral edge of the sole structure 100.

Referring to FIG. 7, each of the cushions 130 includes tubular body 134, a first terminal end 136 disposed at a first end of the tubular body 134, and a second terminal end 138 disposed at an opposite end of the tubular body 134 from the first terminal end 136. The tubular body 134 defines a substantially circular cross section that extends along a longitudinal axis $A_{130}$ of the cushion 130. As shown, the thickness $T_{118}$ of the chamber 118 increases continuously along the longitudinal axis $A_{130}$ from a first thickness $T_{118\text{-}1}$ at the first terminal end 136 to a second thickness $T_{118\text{-}2}$ at the second terminal end 138. Thus, the thickness of the chamber 118 may be described as tapering along the direction from the second terminal end 138 to the first terminal end 136.

Figure 12:
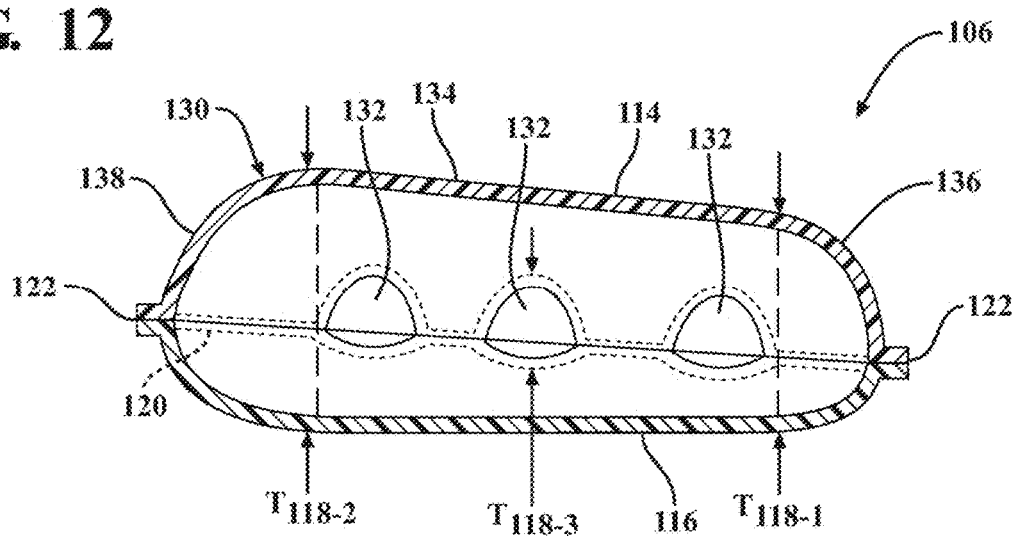
FIG. 12 is a cross-sectional view of the bladder of FIG. 11, taken along Line 12-12 of FIG. 11.

As shown in FIG. 12, the first terminal end 136 and the second terminal end 138 of each cushion 130 are substantially dome-shaped, and each includes compound curvatures associated with the respective upper and lower barrier layers 114, 116. For example, the first terminal end 136 of each cushion 130 is formed where an end portion of the upper barrier layer 114 converges with and is joined to the lower barrier layer 116 at the peripheral seam 122 to enclose an anterior end of the tubular body 134. Referring still to FIG. 12, the second terminal end 138 of each cushion 130 is formed where another end portion of the upper barrier layer 114 converges with and is joined to the lower barrier layer 116 at the peripheral seam 122 to enclose the opposite end of the tubular body 134.

As provided above, each of the cushions 130 defines a respective longitudinal axis $A_{130}$ that extends from the first terminal end 136 to the second terminal end 138. As best shown in FIG. 11, the cushions 130 are spaced apart from each other along a direction transverse to the longitudinal axes $A_{106}$ of the bladder 106. Accordingly, when the bladder 106 is assembled within the sole structure 100, the cushions 130 are spaced apart from each other along a lateral direction of the article of footwear 10 such that a first one of the cushions 130 extends along the lateral side 22 and a second one of the cushions 130 extends along the medial side 24. Furthermore, the longitudinal axes $A_{130}$ of the cushions 130 converge with each other and with the longitudinal axis $A_{10}$ of the article of footwear 10 along the direction from the posterior end 20 to the anterior end 18. Accordingly, a lateral distance D1 between the cushions 130 is greater at the second terminal ends 138 than at the first terminal ends 136.

With continued reference to FIGS. 11 and 12, the chamber 118 further includes at least one conduit 132 extending between and fluidly coupling the cushions 130. In the illustrated example, the chamber 118 includes a plurality of the conduits 132 connecting the tubular bodies 134 of the cushions 130 to each other. The conduits 132 each extend along respective longitudinal axes $A_{132}$ that are transverse to the longitudinal axes $A_{130}$ of the cushions 130. As best shown in FIGS. 11 and 12, the conduits 132 include a first conduit 132 extending between the tubular bodies 134 of the cushions 130 adjacent to the first terminal ends 136, a second conduit 132 extending between the tubular bodies 134 of the cushions 130 adjacent to the second terminal ends 138, and a third conduit 132 disposed between the first conduit 132 and the second conduit 132 and connecting intermediate portions of the tubular bodies 134. Accordingly, the first conduit 132 and the second conduit 132 are disposed on opposite sides of the third conduit 132.

As best shown in FIGS. 9 and 12, the conduits 132 are defined by the cooperation of the upper barrier layer 114 and the lower barrier layer 116. As shown in FIG. 12, the upper barrier layer 114 and the lower barrier layer 116 are formed to provide a plurality of semi-cylindrically shaped conduits 132, each having a substantially similar third thickness $T_{118\text{-}3}$ that is less than the first thickness $T_{118\text{-}1}$ and the second thickness $T_{118\text{-}2}$ of the cushions 130. A profile of each of the conduits 132 is substantially defined by the upper barrier layer 114, whereby the upper barrier layer 114 is molded to define a curved upper portion of each conduit 132 while the lower barrier layer 116 is provided as substantially flat lower portion of each of the conduits 132. Although the lower barrier layer 114 is initially provided in a substantially flat state, the lower barrier layer 116 may bulge from the web area 120 when the chamber 118 is pressurized and the lower barrier layer 116 is biased apart from the upper barrier layer 114, as illustrated in FIG. 7.

With reference to FIGS. 7 and 11, the web area 120 is formed at a bonded region of the upper barrier layer 114 and the lower barrier layer 116, and extends between and connects each of the segments 130, 132 of the chamber 118. Particularly, the web area 120 includes an anterior portion extending between and connecting the first terminal ends 136 of the respective cushions 130, and defining a first terminal edge at an anterior end of the bladder 106. A posterior portion of the web area 120 extends between and connects the second terminal ends 138 of the cushions 130, and forms a second terminal edge at a posterior end of the bladder 106. Intermediate portions of the web area 120 extend between and connect adjacent ones of the conduits 132 and the cushions 130. Accordingly, the intermediate portions of the web area 120 may be completely surrounded by the chamber 118. In the illustrated example, the web area 120 is disposed vertically intermediate with respect to the overall thickness $T_{118}$ of the fluid-filled chamber 118.

In the illustrated example, the web area 120 and the cushions 130 of the chamber 118 cooperate to define an upper pocket 140 on a first side of the bladder 106 associated with the upper barrier layer 114. Here, the conduits 132 may be disposed within the upper pocket 140 to form an alternating series of bulges and recesses along a length of the upper pocket 140. As described in greater detail below, the chassis 108 may include one or more features configured to mate with the upper pocket 140 when the sole structure 100 is assembled. For instance, the chassis 108 may include indentations and protrusions configured to engage the bulges and recesses formed by the conduits 132 of the bladder 106.

As used herein, the term "barrier layer" (e.g., barrier layers 114, 116) encompasses both monolayer and multilayer films. In some embodiments, one or both of barrier layers 114, 116 are each produced (e.g., thermoformed or blow molded) from a monolayer film (a single layer). In other embodiments, one or both of barrier layers 114, 116 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers 114, 116 can independently be transparent, translucent, and/or opaque. For example, the upper barrier layer 114 may be transparent, while the lower barrier layer 116 is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

Barrier layers 114, 116 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthal ene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 114, 116 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 114, 116 include two or more sublayers, examples of suitable multilayer films include microlayer films, such as those disclosed in Bonk et al., U.S. Pat. No. 6,582,786, which is incorporated by reference in its entirety. In further embodiments, barrier layers 114, 116 may each independently include alternating sublayers of one or more TPU copolymer materials and one or more EVOH copolymer materials, where the total number of sublayers in each of barrier layers 114, 116 includes at least four (4) sublayers, at least ten (10) sublayers, at least twenty (20) sublayers, at least forty (40) sublayers, and/or at least sixty (60) sublayers.

The chamber 118 can be produced from the barrier layers 114, 116 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 114, 116 can be produced by co-extrusion followed by vacuum thermoforming to produce an inflatable chamber 118, which can optionally include one or more valves (e.g., one way valves) that allows the chamber 118 to be filled with the fluid (e.g., gas).

The chamber 118 can be provided in a fluid-filled (e.g., as provided in footwear 10) or in an unfilled state. The chamber 118 can be filled to include any suitable fluid, such as a gas or liquid. In an aspect, the gas can include air, nitrogen ($N_2$), or any other suitable gas. In other aspects, the chamber 118 can alternatively include other media, such as pellets, beads, ground recycled material, and the like (e.g., foamed beads and/or rubber beads). The fluid provided to the chamber 118 can result in the chamber 118 being pressurized. Alternatively, the fluid provided to the chamber 118 can be at atmospheric pressure such that the chamber 118 is not pressurized but, rather, simply contains a volume of fluid at atmospheric pressure.

The chamber 118 desirably has a low gas transmission rate to preserve its retained gas pressure. In some embodiments, the chamber 118 has a gas transmission rate for nitrogen gas that is at least about ten (10) times lower than a nitrogen gas transmission rate for a butyl rubber layer of substantially the same dimensions. In an aspect, the chamber 118 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 114, 116). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper and lower barrier layers 114, 116 are formed by respective mold portions each defining various surfaces for forming depressions and pinched surfaces corresponding to locations where the web area 120 and/or the peripheral seam 122 are formed when the upper barrier layer 114 and the lower barrier layer 116 are joined and bonded together. In some implementations, adhesive bonding joins the upper barrier layer 114 and the lower barrier layer 116 to form the web area 120 and the peripheral seam 122. In other implementations, the upper barrier layer 114 and the lower barrier layer 116 are joined to form the web area 120 and the peripheral seam 122 by thermal bonding. In some examples, one or both of the barrier layers 114, 116 are heated to a temperature that facilitates shaping and melding. In some examples, the barrier layers 114, 116 are heated prior to being located between their respective molds. In other examples, the mold may be heated to raise the temperature of the barrier layers 114, 116. In some implementations, a molding process used to form the fluid-filled chamber 118 incorporates vacuum ports within mold portions to remove air such that the upper and lower barrier layers 114, 116 are drawn into contact with respective mold portions. In other implementations, fluids such as air may be injected into areas between the upper and lower barrier layers 114, 116 such that pressure increases cause the barrier layers 114, 116 to engage with surfaces of their respective mold portions.

In the illustrated example, the chassis 108 extends continuously from the anterior end 18 to the posterior end 20, and is configured to receive and support the bladder 106 therein. As shown, the chassis 108 is formed as a composite structure including a cushioning element 110 and a cradle 112 received at least partially within the cushioning element 110. As discussed below, the cradle 112 is configured to receive and support the bladder 106 within the heel region 16 of the cushioning element 110. While the cushioning element 110 and the cradle 112 of the illustrated example are shown as separate components that cooperate to form the chassis 108, in some examples the chassis 108 may be formed as a unitary body.

Figure 6:
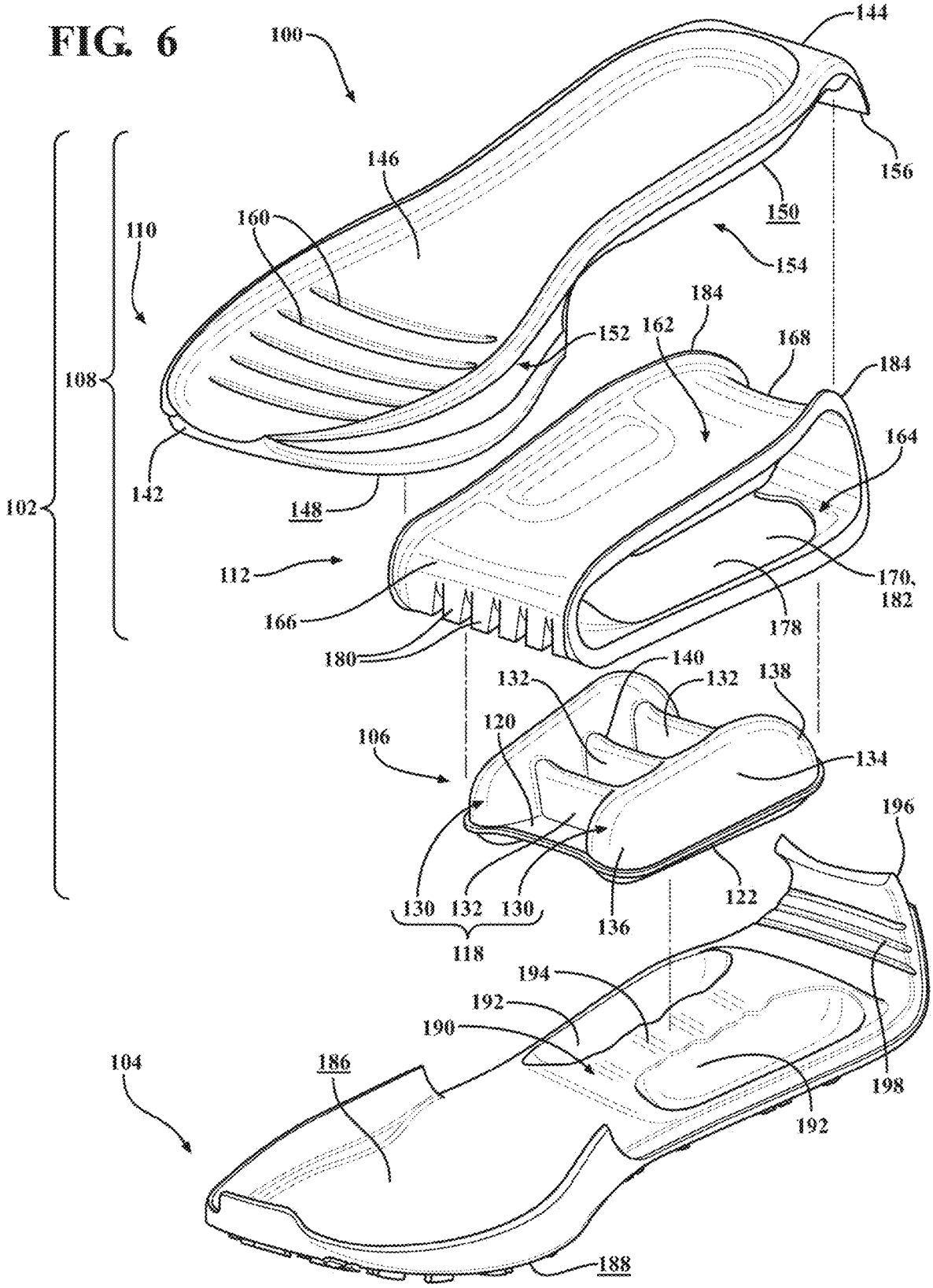
FIG. 6 is a top perspective exploded view of the sole structure of FIG. 5.

The cushioning element 110 is formed of a first material, and extends continuously from a first end 142 at the anterior end 18 of the sole structure 100 to a second end 144 at the posterior end 20 of the sole structure 100. The cushioning element 110 includes a top surface 146 extending continuously from the first end 142 to the second end 144, which defines a footbed of the chassis 108. The cushioning element 110 further includes a bottom surface 148 formed on an opposite side of the cushioning element 110 from the top surface 146. A distance from the top surface 146 to the bottom surface 148 defines an overall thickness Ti to (FIG. 7) of the cushioning element 110. As best shown in FIGS. 5 and 6, the cushioning element 110 further includes a recessed surface 150 offset from the bottom surface 148 towards the top surface 146.

As shown, the aforementioned surfaces 146, 148, 150 of the cushioning element 110 cooperate to define a support member 152 in the forefoot region 12 and a recess 154 in the heel region 16. In the illustrated example, the cushioning element 110 further includes an upper posterior lip 156 depending from the recessed surface 150 at the second end 144 of the cushioning element 110, which cooperates with a corresponding portion of the outsole 104 to enclose the cradle 112 at the posterior end 20 of the sole structure 100, as described in greater detail below.

The support member 152 of the cushioning element 110 is formed between the top surface 146 and the bottom surface 148, and extends continuously from the first end 142 of the cushioning element 110 to an end wall 158 in the mid-foot region 14. Accordingly, the support member 152 provides cushioning and support characteristics of the chassis 108 in the forefoot region, beneath the phalanges and the ball of the foot. Optionally, the support member 152 may include one or more flexions 160 to improve flexibility of the support member 152. In the illustrated example, the flexions 160 are embodied as a series grooves 160 formed in the top surface 146, where each of the grooves 160 extends across the forefoot region 12 in a direction from the lateral side 22 to the medial side 24.

With continued reference to FIG. 5, the recess 154 is defined, in part, by the recessed surface 150. In the illustrated example, the recess 154 is bounded on opposite ends by the end wall 158 in the mid-foot region 14 and by the lip 156 at the posterior end 20 of the sole structure 100. Accordingly, the recess 154 extends from the mid-foot region 14 to the posterior end 20. A depth of the recess 154, defined by the offset distance from the bottom surface 148 to the recessed surface 150, corresponds to a height of the cradle 112. Accordingly, when the cradle 112 is received within the recess 154 the bottom portion of the cradle 112 is flush with the bottom surface 148 of the cushioning element 110 to provide a continuous support surface along the bottom of the chassis 108.

As described above, the cushioning element 110 is formed of a resilient polymeric material, such as foam or rubber, to impart properties of cushioning, responsiveness, and energy distribution to the foot of the wearer. Example resilient polymeric materials for the cushioning element 110 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 1-5, the cradle 112 is received within the recess 154 of the cushioning element 110, and cooperates with the cushioning element 110 and the outsole 104 to support the bladder 106. In the illustrated example, the cradle 112 includes a top plate 162 and a bottom plate 164 connected to each other at opposite ends of the cradle 112 by a first end support 166 and a second end support 168. When the sole structure 100 is assembled, the top plate 162 is received against the recessed surface 150 of the cushioning element 110. Here, the first end support 166 of the cradle 112 is disposed adjacent to and faces the end wall 158 of the recess 154, while the second end support 168 is adjacent to and faces the lip 156 of the cushioning element 110 at the posterior end 20 of the sole structure 100. As best shown in FIG. 3, the cradle 112 extends beyond the upper 200 at the posterior end 20 such that the second end support 168 is positioned behind a posterior end of the upper 200, thereby providing a cantilevered configuration at the posterior end 20 of the article of footwear 10. The plates 162, 164 and end supports 166, 168 cooperate to define an internal receptacle 170 configured to receive the bladder 106 therein when the sole structure 100 is assembled.

As shown, the top plate 162 extends from the first end support 166 to the second end support 168 and defines an upper portion of the receptacle 170. The top plate 162 includes a projection 172 extending from an interior surface of the top plate 162 into the receptacle 170. Generally, the projection 172 is configured to at least partially mate with the pocket 140 formed by the upper barrier layer 114 of the bladder 106. As shown, the projection 172 includes a plurality of ribs 174 arranged in series along a direction from the first end support 166 to the second end support 168. Each of the ribs 174 extends from the projection 172 to a distal end 176 facing the bottom plate 164. Here, the ribs 174 are configured to be received between adjacent ones of the conduits 132 of the bladder 106. Accordingly, sides of the ribs 174 may be concave to receive corresponding convex portions of the conduits 132. As best shown in the cross-sectional view of FIG. 7, the ribs 174 may not extend fully between the conduits 132, such that the distal ends 176 are spaced apart from the web area 120 when the sole structure 100 is assembled.

The bottom plate 164 also extends from the first end support 166 to the second end support 168 and defines a lower portion of the receptacle 170. However, as best shown in FIGS. 5 and 6, the bottom plate 164 includes an aperture 178 formed therethrough, which provides an opening into the receptacle 170 for receiving the bladder 106. The aperture 178 has a peripheral profile corresponding to a peripheral profile of the bladder 106. As shown in FIGS. 7 and 9, when the sole structure 100 is assembled, the bladder 106 may sit within the aperture 178 so that the perimeter of the aperture 178 surrounds the perimeter of the bladder 106.

As shown in FIGS. 5 and 6, the top plate 162 and the bottom plate 164 are connected to each other at opposite ends of the cradle 112 by the end supports 166, 168. Each of the end supports 166, 168 has an arcuate cross-sectional shape, and forms a semi-cylindrical shape at each end of the cradle 112. The arcuate shape of each end support 166, 168 forms a resilient structure at each end of the cradle 112, which allows the plates 162, 164 to be compressed towards each other. The end supports 166, 168 may have different radiuses to provide different spring rates at each end of the cradle 112.

An overall height $H_{112}$ (FIG. 7) of the cradle 112 is defined as the distance from the top plate 162 to the bottom plate 164. In the illustrated example, the height $H_{112}$ of the cradle 112 at each of the end supports 166, 168 corresponds to a radius of the respective end support 166, 168. As shown, the first end support 166 has a smaller radius than the second end support 168 such that the height $H_{112}$ of the cradle increases along the direction from the first end support 166 to the second end support 168. Accordingly, the cradle 112 may have a smaller height Hi 12 at the first end support 166 than at the second end support 168 to form a wedge-shaped cradle 112 in the heel region 16.

Optionally, the first end support 166 may include a plurality of buttresses 180 for providing longitudinal stability and stiffness to the cradle 112. In the illustrated example, the buttresses 180 are formed as a series of teeth 180 projecting from a lower portion of the first end support 166. Each tooth includes a front side extending tangentially from a forward-most point of the first end support 166 and a bottom side formed flush with the bottom plate 162. Thus, sides of the buttresses 180 intersect with each other adjacent to the outsole 104 to provide the lower portion of the first end support 166 with increased thickness. In use, the buttresses 180 provide longitudinal stiffness to the end support 166. Accordingly, the buttresses 180 may minimize deformation when forces are applied to the top plate 162 in a direction towards the anterior end 18, such as when stopping or landing during forward motion.

As provided above, the plates 162, 164 and the end supports 166, 168 cooperate to define the receptacle 170 of the cradle 112 for receiving the bladder 106 therein. As shown, the respective edges of the plates 162, 164 and the supports 166, 168 may cooperate to define openings 182 into the receptacle 170 on opposite sides of the cradle 112. In other words, the receptacle 170 extends continuously through the cradle 112 from the lateral side 22 to the medial side 24. In some examples, each opening 182 may be circumscribed by a flange 184 extending outwardly (i.e., away from the opening 182) from the edges of the plates 162, 164 and the end supports 166, 168. Accordingly, the flanges 184 extend outwardly around each side of the cradle 112 and may receive the cushioning element 110 and the outsole 104 therebetween to secure a lateral position of the cradle 112 in the sole structure 100.

With reference to FIGS. 5 and 6, the outsole 104 includes an inner surface 186 facing the midsole 102 and an exterior surface 188 defining a ground-engaging surface of the sole structure 100. The outsole 104 may include a socket 190 formed on the inner surface 186, which is configured to receive a lower portion (e.g., the lower barrier layer 116) of the bladder 106 when the sole structure 100 is assembled. As shown in FIG. 6, the socket 190 includes a pair of channels 192 formed on opposite sides of an elongate central protuberance 194. Each of the channels 192 is configured to receive a lower portion of one of the cushions 130. Accordingly, the channels 192 have a profile and arrangement corresponding to the shape (e.g., elongate with rounded ends) and arrangement (e.g., converging) of the cushions 130.

The protuberance 194 of the socket 190 is configured to be received between the lower portions of the cushions 130, adjacent to the web area 120. As shown in FIG. 9, the protuberance 194 contacts the lower barrier layer 116 along the web area 120 and is formed along the inner surface 186 by a portion of the outsole 104 that is indented between the channels 192. As such, the protuberance 194 may form a depression in the exterior surface 188 of the outsole 104 between the cushions 130 of the bladder 106. In use, the web area 120 and the protuberance 194 may provide a trampoline-like response between the cushions 130 of the bladder 106 when the heel region 16 is compressed by the heel of the foot.

The outsole 104 further includes a lower lip 196 configured to cooperate with the upper lip 156 of the cushioning element 110 to encompass the second end support 168 of the cradle 112. As best shown in the cross-sectional view of FIG. 7, the lower lip 196 extends upwardly from the outsole 104 and around a lower portion of the second end support 168 of the cradle 112. In the illustrated example, the distal end of the upper lip 156 partially overlaps the distal end of the lower lip 196 to form a lap joint between the lips 156, 196. Optionally, the lower lip 196 may include a plurality of flexions 198 formed in the inner surface 186 of the outsole 104. The flexions 198 of the lower lip 196 are configured as grooves extending across a width of the outsole 104, which allow the lower lip 196 to be conformed to the outer surface of the second end support 168.

As set forth above, the components of the sole structure 100 cooperate to form a pressure-responsive shock-absorber in the heel region 16 of the sole structure 100. Here, the bladder 106 is constrained between the top plate 162 and the socket 190 of the outsole 104. Accordingly, the bladder 106 provides cushioning and support along an intermediate portion of the cradle 112. As best shown in FIG. 3, the ends 136, 138 of the cushions 130 are spaced apart from the end supports 166, 168 of the cradle 112. As provided above, the end supports 166, 168 are arcuate in shape and, as such, are configured to bend or flex when the top plate 162 and the bottom plate 164 are compressed towards each other. Accordingly, the end supports 166, 168 provide supplementary support and cushioning to the bladder 106 in the heel region 16. In some examples, the end supports 166, 168 may be resilient structures that provide a responsive reaction to the foot after compression, similar to a spring.

While the chassis 108 and bladder 106 provide cushioning properties in the heel region 16, the support member 152 provides cushioning and support in the forefoot region 12. In some instances, the material of the cushioning element 110 may provide different performance characteristics than the chassis 108 and bladder 106. For example, the support member 152 may provide localized, micro-level cushioning along the forefoot region 12 where the foot includes more joints, while the cradle provides more general, macro-level cushioning at the heel region 16 where the calcaneus bone is located.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

The following Clauses provide exemplary configurations for an article of footwear, a bladder for an article of footwear, or a sole structure for an article of footwear described above.

Clause 1. A sole structure for an article of footwear, the sole structure comprising a cushioning element including a first material, a cradle including a second material, attached to the cushioning element, and including a first plate disposed against the cushioning element and a second plate spaced apart from the cushioning element, the second plate including an aperture, and a bladder disposed within the cradle and including a first portion contacting the first plate and a second portion extending through the aperture of the second plate.

Clause 2. The sole structure of Clause 1, further comprising an outsole disposed adjacent to the second plate on an opposite side of the cradle from the cushioning element.

Clause 3. The sole structure of Clause 2, wherein the second portion of the bladder contacts the outsole.

Clause 4. The sole structure of any of the preceding Clauses, wherein the second plate surrounds the second portion of the bladder.

Clause 5. The sole structure of any of the preceding Clauses, wherein the first plate and the second plate partially define a receptacle extending continuously through the cradle from a first side to a second side.

Clause 6. The sole structure of Clause 5, wherein the cradle includes an arcuate first end support connecting the first plate and the second plate at a first end of the cradle.

Clause 7. The sole structure of Clause 6, wherein the first end support is spaced apart from the bladder.

Clause 8. The sole structure of Clause 6, wherein the cradle includes an arcuate second end support connecting the first plate and the second plate at a second end of the cradle.

Clause 9. The sole structure of Clause 8, wherein the first end support and the second end support are spaced apart from the bladder.

Clause 10. The sole structure of Clause 8, wherein the first end support is a different size than the second end support.

Clause 11. A sole structure for an article of footwear, the sole structure comprising a cushioning element, a cradle received by the cushioning element and defining a receptacle extending continuously through the cradle from a first side of the sole structure to a second side of the sole structure, and a bladder including a first portion disposed within the receptacle and a second portion extending through the cradle.

Clause 12. The sole structure of Clause 11, further comprising an outsole disposed on an opposite side of the cradle from the cushioning element.

Clause 13. The sole structure of Clause 12, wherein the second portion of the bladder contacts the outsole through the cradle.

Clause 14. The sole structure of any of the preceding Clauses, wherein the cradle includes a first plate surrounding the second portion of the bladder.

Clause 15. The sole structure of Clause 14, wherein the cradle includes a second plate spaced apart from the first plate, the first portion of the bladder contacting the second plate.

Clause 16. The sole structure of Clause 15, wherein the cradle includes an arcuate first end support connecting the first plate and the second plate at a first end of the cradle.

Clause 17. The sole structure of Clause 16, wherein the first end support is spaced apart from the bladder.

Clause 18. The sole structure of Clause 16, wherein the cradle includes an arcuate second end support connecting the first plate and the second plate at a second end of the cradle.

Clause 19. The sole structure of Clause 18, wherein the first end support and the second end support are spaced apart from the bladder.

Clause 20. The sole structure of Clause 18, wherein the first end support is a different size than the second end support.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a cushioning element;

an outsole including a ground-engaging surface and an upper surface formed on an opposite side of the outsole than the ground-engaging surface and opposing the cushioning element, the upper surface including a first channel extending along a medial side of the outsole and a second channel extending along a lateral side of the outsole, the outsole defining a protuberance disposed between the first channel and the second channel and extending in a direction toward the cushioning element;

a first cushion disposed between the outsole and the cushioning element and received within the first channel;

a second cushion disposed between the outsole and the cushioning element and received within the second channel, the first cushion and the second cushion each exposed at a respective one of the medial side of the outsole and the lateral side of the outsole;

a series of elongate conduits, each conduit extending in parallel to an adjacent conduit of the series of elongate conduits and transverse to a longitudinal axis of the sole structure; and a web area joining the first cushion and the second cushion and in contact with the protuberance.

2. The sole structure of claim 1, wherein the first channel and the second channel are convergent.

3. The sole structure of claim 1, wherein the first cushion and the second cushion are fluid-filled chambers.

4. The sole structure of claim 3, wherein the first cushion and the second cushion are in fluid communication with one another via at least one conduit of the series of elongate conduits.

5. The sole structure of claim 4, wherein the at least one conduit extends transverse to a longitudinal axis of the first cushion and to a longitudinal axis of the second cushion.

6. The sole structure of claim 1, wherein the first cushion is elongate and extends along a first longitudinal axis and the second cushion is elongate and extends along a second longitudinal axis.

7. A sole structure for an article of footwear, the sole structure comprising:

a cushioning element;

an outsole spaced apart from the cushioning element to define a recess between the cushioning element and the outsole;

a cradle disposed within the recess and including a first plate disposed against the cushioning element and a second plate in contact with the outsole and spaced apart from the first plate to define a receptacle therebetween, the cradle tapering in a first direction from a posterior end of the cradle to an anterior end of the cradle; and a bladder disposed within the recess and including a series of elongate conduits, each conduit extending in parallel to an adjacent conduit of the series of elongate conduits and transverse to a longitudinal axis of the sole structure.

8. The sole structure of claim 7, wherein the receptacle tapers in the first direction.

9. The sole structure of claim 7, further comprising a first end support located at the anterior end of the cradle and extending between and connecting the first plate and the second plate and a second end support located at the posterior end of the cradle and extending between and connecting the first plate and the second plate.

10. The sole structure of claim 9, wherein the first end support is arcuate.

11. The sole structure of claim 10, wherein the second end support is arcuate.

12. The sole structure of claim 7, wherein the receptacle extends through the cradle from a medial side of the cradle to a lateral side of the cradle.

13. The sole structure of claim 12, wherein the medial side of the cradle is exposed at a medial side of the sole structure and the lateral side of the cradle is exposed at a lateral side of the sole structure.

14. The sole structure of claim 7, wherein the second plate includes an aperture formed therethrough.

15. The sole structure of claim 14, wherein the bladder further includes a first cushion disposed within the receptacle of the cradle, the first cushion extending through the aperture.

16. The sole structure of claim 15, wherein the outsole includes a ground-engaging surface and an upper surface formed on an opposite side of the outsole than the ground-engaging surface and opposing the cushioning element, the first cushion in contact with the upper surface of the outsole.

* * * * *